US007803248B2

(12) United States Patent
Pinkham, Jr. et al.

(10) Patent No.: US 7,803,248 B2
(45) Date of Patent: Sep. 28, 2010

(54) METHOD OF DRYING MAT PRODUCTS

(75) Inventors: Daniel Pinkham, Jr., Highlands Ranch, CO (US); Gerard Joseph Demott, Evergreen, CO (US); Gary Groner, Littleton, CO (US)

(73) Assignee: Johns Manville, Denver, CO (US)

( * ) Notice: Subject to any disclaimer, the term of this patent is extended or adjusted under 35 U.S.C. 154(b) by 681 days.

(21) Appl. No.: 11/805,375

(22) Filed: May 23, 2007

(65) Prior Publication Data

US 2008/0289788 A1 Nov. 27, 2008

(51) Int. Cl.

| | |
|---|---|
| ***D21F 5/20*** | (2006.01) |
| ***D21F 5/18*** | (2006.01) |
| ***D21H 21/18*** | (2006.01) |
| ***F26B 3/06*** | (2006.01) |
| ***F26B 21/14*** | (2006.01) |

(52) U.S. Cl. ..... 162/156; 162/201; 162/207; 34/86; 34/90; 34/452

(58) Field of Classification Search ..... 162/145, 162/152, 156, 201, 207, 290, 375, 381; 34/86, 34/90, 424, 446, 459, 452
See application file for complete search history.

(56) References Cited

U.S. PATENT DOCUMENTS

| | | | | |
|---|---|---|---|---|
| 3,253,897 | A * | 5/1966 | Falls | 65/111 |
| 3,766,003 | A | 10/1973 | Schuller et al. | |
| 3,865,540 | A * | 2/1975 | Loeffler | 432/2 |
| 4,112,174 | A | 9/1978 | Hannes et al. | |
| 4,129,674 | A | 12/1978 | Hannes et al. | |
| 4,146,361 | A * | 3/1979 | Cirrito | 432/60 |
| 4,263,007 | A * | 4/1981 | Battigelli et al. | 425/371 |
| 4,337,585 | A * | 7/1982 | Hebrank | 34/86 |
| 4,681,802 | A | 7/1987 | Gaa et al. | |
| 4,780,967 | A * | 11/1988 | Mucic | 34/86 |
| 4,810,576 | A | 3/1989 | Gaa et al. | |
| 5,484,653 | A | 1/1996 | Kennedy et al. | |
| 5,772,846 | A | 6/1998 | Jaffee | |
| 5,974,691 | A * | 11/1999 | Marchal et al. | 34/456 |
| 6,098,309 | A * | 8/2000 | Halmschlager et al. | 34/420 |
| 6,869,506 | B2 * | 3/2005 | Jewitt | 162/207 |
| 6,910,283 | B1 * | 6/2005 | Reddy | 34/446 |
| 7,150,111 | B2 * | 12/2006 | Viljanmaa | 34/446 |

* cited by examiner

*Primary Examiner*—Eric Hug
(74) *Attorney, Agent, or Firm*—Robert D. Touslee

(57) ABSTRACT

The invention includes a method and system for generating electricity using a drive for the electrical generator that is powered by an engine that uses high pressure hot gases produced by combustion of a fuel and an oxygen bearing gas, using at least a portion of the electricity generated to power manufacturing plant equipment and using the waste hot exhaust gases from the heat engine, such as a gas turbine, with or without a heat exchanger, in an oven in which the mat is carried through continuously on a belt, drum or with other conventional means to dry the wet fibrous mats. Optionally the fibrous mats can contain a binder and the hot waste gases can be optionally used to cure a binder.

20 Claims, 4 Drawing Sheets

METHOD OF DRYING MAT PRODUCTS

The invention involves the use of waste hot gases from any source, such as waste heat from a heat engine used in electrical generation, to dry wet, fibrous mats in an oven.

BACKGROUND

It is known to make fibrous mats for stabilizing and reinforcing plastics and other materials by dispersing fibers in an aqueous mixture and optionally applying a binder to the wet mat followed by drying the mat and curing the binder in a heated oven. The wet mats are dried in a continuous manner by carrying the wet mat into and through the oven, usually a gas or oil fired oven, to remove the water and to cure the binder to bond the fibers together. Such processes are disclosed in U.S. Pat. Nos. 3,766,003, 4,129,674, 4,112,174, 4,681,802, 4,810,576, and 5,484,653 and 5,772,846, the disclosures of which are hereby incorporated herein by reference.

Ovens are known for drying wet fibrous mats continuously by carrying the fibrous mat through the oven on a moving permeable belt, a permeable drum or one or more non-permeable rotating drums. The ovens using a permeable moving belt include ovens that can dry by impingement of hot gases onto the top surface of the mat or that draw the hot gases through the porous mat, even when wet, to dry and heat the mat much faster than the impingement ovens. The ovens using a rotating permeable drum operate by rapidly pulling the hot gases through the porous mat and on through the permeable bed of the drum on its cylindrical surface and exhausts the cooler, spent gases through a hollow axle having an axis about which the drum rotates. Such ovens are called Honeycomb™ dryers. Other ovens use non-permeable drums or cans heated from the inside by passing steam or hot gases through the interior of the drum. These ovens take longer to dry and heat the mats, using conduction primarily to transfer the heat from the drum's cylindrical surface to the fibrous mat, therefore a plurality of drums are normally used in such ovens to permit the desired mat speed. All of these ovens, and their equivalents or similar ovens known for drying and heating permeable fibrous mats, are suitable for the practice of the invention.

It is also known to generate electricity using a gas turbine or other heat engine that exhausts gases at elevated temperatures and it is known to use these gases in a heat exchanger to preheat the air and/or gaseous fuel used to drive the gas turbine or heat engine.

SUMMARY OF THE INVENTION

The invention includes a method and system for drying wet, fibrous mats, such as nonwoven fibrous mats, using waste heat from any source. The waste heat should have a temperature of at least 100 degrees C. and more typically at least about 105 degrees C., and be less than saturated with water. Some sources of waste heat include waste hot exhaust gases from a heat engine like a gas turbine used in an electrical generating system and from a glass furnace before or following a heat exchanger or from a recuperator on a glass furnace, etc. Waste hot gases coming from a heat engine will usually exceed 200 degrees C., typically the temperature is in a range of about 390-450 degrees C. or higher, but the temperature of the waste exhaust gases can be hotter than 540 degrees C. These temperatures are also typical of waste hot gases coming from a furnace like a glass melting furnace. The pressure of these hot waste hot gases exhausting from the heat engines, furnaces or recuperators will typically be less than 1 psi gauge, more typically less than 18 inches water column, however the pressure can be boosted by the use of a conventional fan that can be used to push the waste hot gases through one or more ducts and into one or more dryers for drying fibrous nonwoven mats.

The invention also includes a method and system for generating electricity using a drive for the electrical generator that is powered by a heat engine, an engine that uses high pressure, hot gases produced by combustion of a fuel and an oxygen bearing gas. When used herein, high pressure, hot gases is meant a gas or mixture of gases having a pressure of at least about 4 psi gauge and a temperature of at least about 600 degrees C. One popular type of heat engine is a gas turbine. The invention includes using at least a portion of the electricity generated to power manufacturing plant equipment and using the waste hot exhaust gases from the heat engine, such as a gas turbine, with or without a heat exchanger, to dry wet fibrous nonwoven mats, and optionally to cure a binder in the mats, in an oven in which the mat is carried through continuously on a belt, drum or with other conventional means.

The invention is useful in any fibrous mat production system and process for making such mats, whether formed dry or wet, but containing water or a solvent that must be removed, and having a permeability of at least about 100 cubic feet/square foot per minute after the mat has been dried. The invention is useful in any type of oven used in systems and processes to remove the water or solvent in the fibrous mats. The content of water or solvent in the wet mat going into the dryer is above 10 wt. percent, based on the weight of the dried mat, and typically is in the range of about 20 wt. percent to about 80-90 wt. percent. The liquid content of the mat will depend on fiber diameter and binder content, but typically is in the range of about 30-60 wt. percent, such as about 45-55 wt. percent.

When the word "about" is used herein it is meant that the amount or condition it modifies can vary some beyond that as long as the advantages of the invention are realized. Practically, there is rarely the time or resources available to very precisely determine the limits of all of the parameters of ones invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors disclosure and understanding the inventive concept and embodiments disclosed including the best mode known to the inventor, the inventor and others can, without inventive effort, explore beyond the limits disclosed to determine if the invention is realized beyond those limits and, when embodiments are found having no further unexpected characteristics, the limits of those embodiments are within the meaning of the term about as used herein. It is not difficult for the artisan or others to determine whether such an embodiment is either as expected or, because of either a break in the continuity of results or one or more features that are significantly better than those reported by the inventor, is surprising and thus an unobvious teaching leading to a further advance in the art.

DETAILS OF PREFERRED EMBODIMENTS

It is known to make reinforcing nonwoven mats from glass fibers and to use these mats as substrates in the manufacture of a large number of roofing and other products. Any known method of making nonwoven mats can be used in this invention, such as the conventional wet laid processes described in the U.S. patents referenced above in the Background. In a typical one of these processes a slurry of glass fiber is made by adding glass fiber to a typical white water in a pulper to disperse the fiber in the white water and to form a slurry having a fiber concentration of about 0.2-1.0 weight %, metering the slurry into a flow of white water to dilute the fiber concentration to 0.1 wt. percent or less, and continuously depositing this mixture onto a moving screen forming wire to dewater and form a wet nonwoven fibrous mat containing a relatively high moisture content usually in the range of at least about 10 wt. percent to at least about 50 wt. percent.

Figure 1:
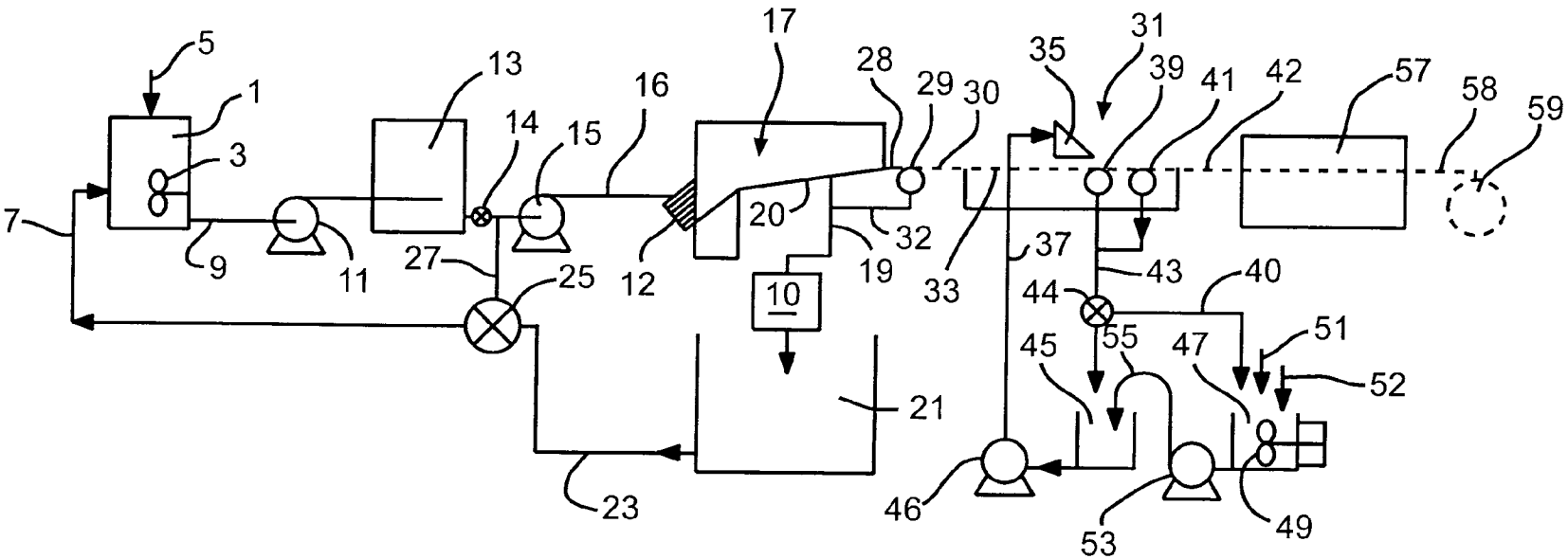
FIG. 1 (PRIOR ART)
FIG. 1 is a schematic of a conventional wet forming fibrous nonwoven mat process line useful in the invention.

FIG. 1 is a schematic of a typical prior art wet former system for making multi-layer nonwoven mats except that it contains two stock preparation systems. Fibers, particulate or both 5 are fed, typically continuously, but batch type preparation is also used, into a pulper 1 containing forming liquid, usually a known aqueous forming liquid flowing in a return pipe 7. Mixing takes place in the pulper 1 with an agitator 3 to form a relatively concentrated slurry that exits the pulper 1 through pipe 9 and into a pump 11 that pumps the concentrated slurry into a holding tank 13. The forming liquid is delivered to pipe 7 by pump 25, pumping the forming liquid coming from a pipe 23 and a deairing tank 21. Concentrated slurry is metered out of the holding tank 13 by a pump 15 and variable flow valve 14 where the concentrated slurry is diluted substantially with the forming liquid coming through pipe 26 to a forming pump 27. The substantially diluted slurry, usually having a solids concentration of less than about 0.04 percent, flows through pipe 16 to a distribution manifold 12 on a forming box 17.

The slurry flows toward a moving permeable forming belt 20 where the fibers and any particulates in the slurries are formed into a wet, nonwoven web while the forming water flows through the forming belt as return forming liquid 19 and onto the deairing tank 21. A final suction tube assembly 29 under the forming belt 20 near where the wet web is removed from the forming belt 20 removes excess forming liquid from the wet web and returns it through pipe 32 to the deairing tank 21. The wet web is then transferred to a second moving permeable belt 30*d* that carries the wet web under a binder applicator 35 where binder is applied in a binder application section 31. Excess binder is removed from the wet web or mat with suction tube assemblies 39 and 41 to reduce the binder level in the mat to the desired level. The bindered mat is then transferred to an oven belt 42 and passed through an oven 57 where the mat is dried and the resin(s) in the binder cured. The dry mat 58 can then be wound into a roll 59 for packaging, shipment and use or storage.

The mat is bound together with a resinous binder in a known manner. The binder is usually an aqueous mixture of water and one or more resins or polymers and other additives in a solution, emulsion or latex as is known. The binder is prepared by adding one or more resinous materials 51 with a liquid 52, normally water, to a mix tank 47 containing an agitator 49. Excess binder removed from the bindered mat with suction boxes 39 and 41 can also be added to the mix tank 47 by way of return pipe 43. The mixed binder is then pumped with pump 53 to a binder holding tank 45 to supply a binder applicator pump 46 that meters the binder at the desired rate using variable valve 44 to the binder applicator 35.

The heat required to dry and cure the mat is conventionally supplied with a plurality of gas or oil fired burners with the hot gases so produced passing through the porous wet or dry mat to remove the water and, in the latter stage of the oven, to heat the mat to about 105-260 degrees C. to cure the binder. The mat is then usually slit into desired widths and wound into rolls. The moist hot gases after passing through the mat, because of its high moisture content and low temperature is then exhausted, sometimes being sent through a fume incinerator to reduce or eliminate undesirable volatiles from the binder. This drying and curing process uses a lot of fuel due to the high moisture content of the mat and the speed of about 90 meters/minute to over a 500 meters/minute that the mat, usually at least about 2 meters wide and up to 5 meters wide or wider, travels through the oven.

Figure 2:
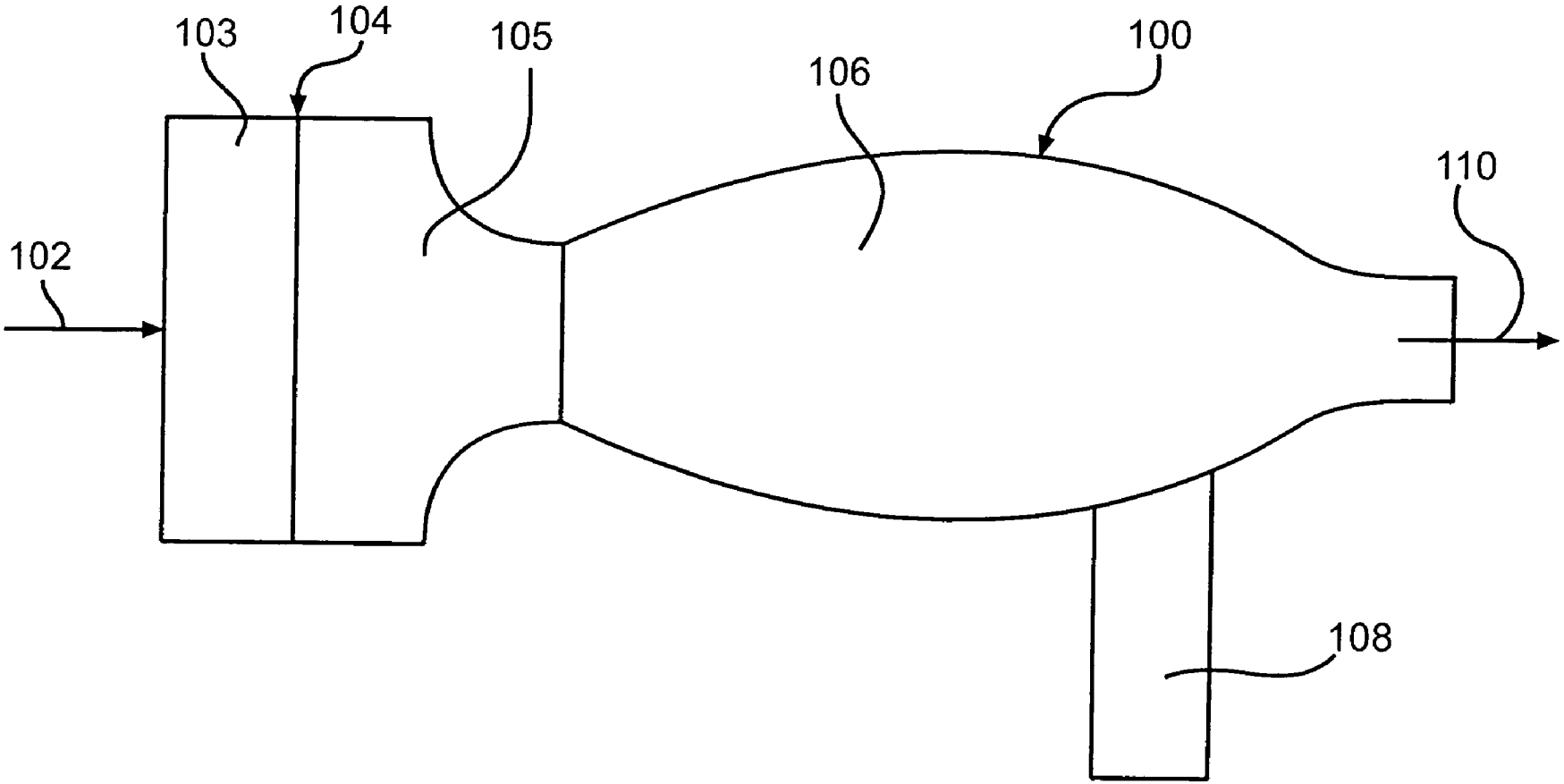
FIG. 2 (PRIOR ART)
FIG. 2 is a schematic of a conventional gas turbine electrical generating system useful in the invention.

FIG. 2 is a schematic of a typical gas turbine driven electrical generating system 1. In this system an oxidizing gas 102 including air, oxygen or an oxygen rich mixture is fed to a compressor 103, driven by a gas turbine 106. The oxidizing gas 102 is compressed and as it exits the compressor 103 into a combustion chamber 105, is mixed with a fuel 104 and ignited producing high pressure hot gases 107 that pass through the gas turbine 106 impacting blades in the turbine 106 causing them to rotate a shaft that drives the compressor 102 and an electrical generator 108 generating electricity. The high pressure hot gases 107 loose pressure as they expend work on the turbine blades and exit the gas turbine 106 as low pressure or atmospheric pressure hot gases 110, usually at a temperatures described above.

In the invention, the waste hot exhaust gases 110 are used in a wet mat forming process like that shown in FIG. 1 to dry the wet fibrous mat and/or to heat the dried fibrous mat to a temperature in the range of about 105-260 degrees C. or more to cure the binder bonding fibers in the mat together.

Figure 3:
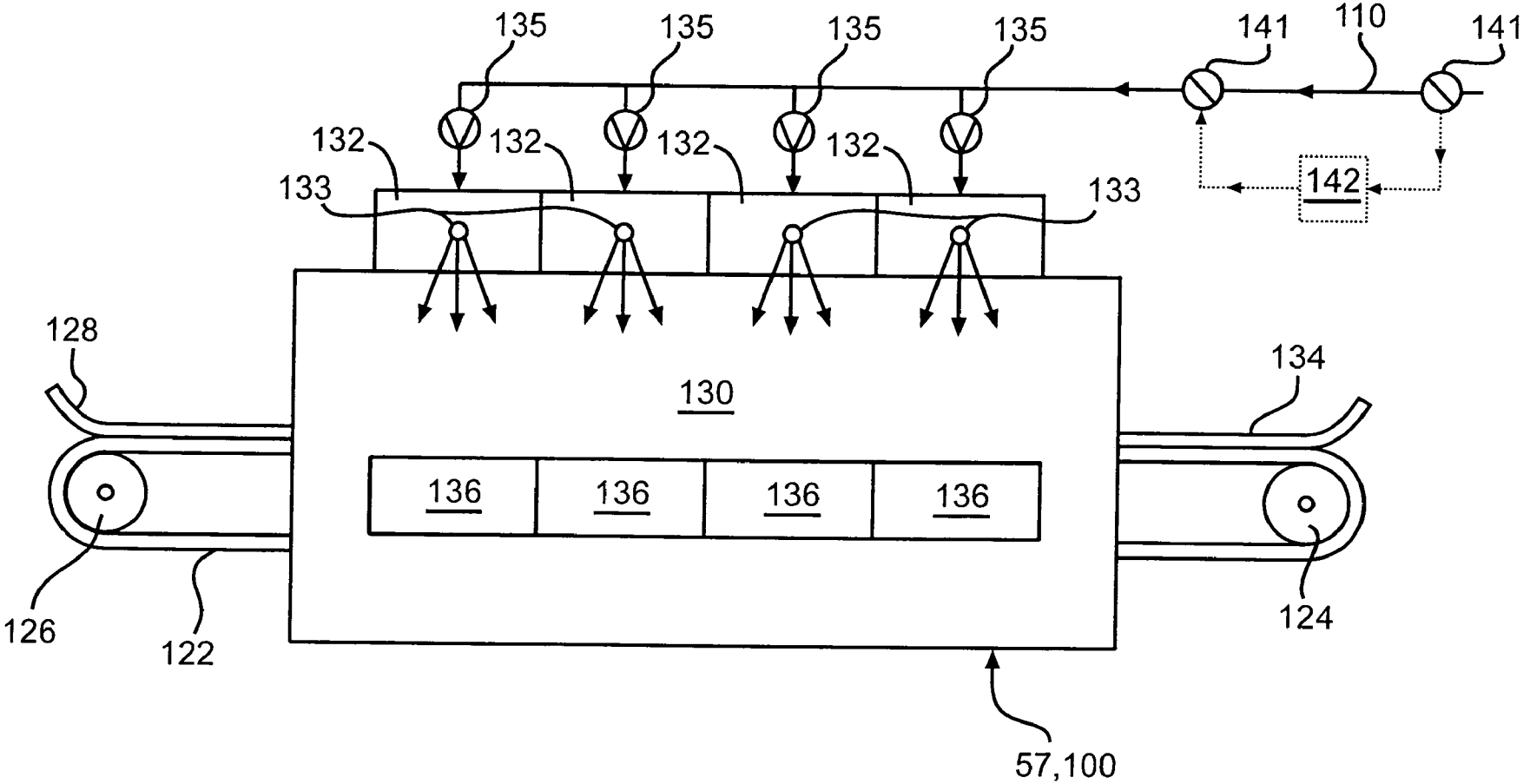
FIG. 3 is a front view of one type of oven useful in the system and process of the invention.

FIG. 3 is a front view of typical oven 120 used in processes like that shown in FIG. 1. This oven 120 is representative of so-called impingement ovens and through-air ovens most typically used in such processes. The differences in these two types of ovens are in their length/capacity and in the types of suction or exhaust fans used and the types of seals used in the ovens, none of which are critical to the invention. The oven 120 comprises a moving permeable belt 122 supported and driven by a tail pulley 124 and/or a head pulley 126. The wet, nonwoven mat 128, usually fibrous and containing at least about 10 wt. percent moisture and usually having a moisture content in the range of about 15 wt. percent to about 30-50 wt. percent, and optionally containing a binder.

The oven 120 comprises a chamber 130 surrounding the permeable belt 122, at least the part of the permeable belt 122 carrying the mat 128 while it is inside the chamber 130, and one or more combustion chambers 132, each having one or more conventional fuel burners capable of producing hot gases 133 for heating and removing the moisture or solvent from the mat 128 and heating the mat further, after the moisture or solvent is removed, to the temperature required to cure to a desired degree the particular type of binder in the mat, producing a dry, hot mat 134 that exits the oven to be either wound up into rolls in a conventional manner (not shown) or to be cut into lengths, stacked and packaged in a conventional manner (not shown). The hot gases are normally pulled into the mat and through and around the mat with one or more conventional suction/exhaust fans (not shown) through exhaust ports 136 located in one or opposite walls of the chamber 130 and below a bottom surface of the permeable belt 122.

In the invention, hot gases 110 exhausted from the gas turbine electrical generating system 100, normally transported via one or more refractory insulation lined ducts, is forced or pulled into one or more of the combustion chambers 132 on the oven 120 to replace part or all of the hot gases that would normally be produced by the one or more burners in those combustion chambers 132. Optionally, ambient air 140 can be metered, using a conventional valve and/or an air fan in a conventional manner, into the stream of hot gases 140 to reduce their temperature if the temperature of the hot gases 110 is greater than desired. Also, optionally, when it is desirable to contact the mat 128 with only hot air, the hot gases 110 can be passed through any conventional heat exchanger 142 to heat ambient air that is then forced or pulled into the oven 130 above the mat 128. The temperature of the hot waste gases 110 can also be reduced before being introduced into the dryer 130 by injecting cooler air or gases into the duct carrying the waste hot gases 110 prior to entry into the oven. It is normal, particularly in the downstream zone or zones of the dryer 130 to inject part of the exhaust gases 136 back into the hot gases 133 to reduce energy usage and this is one way of reducing the temperature of the waste hot gases 110 if desired.

Figure 4:
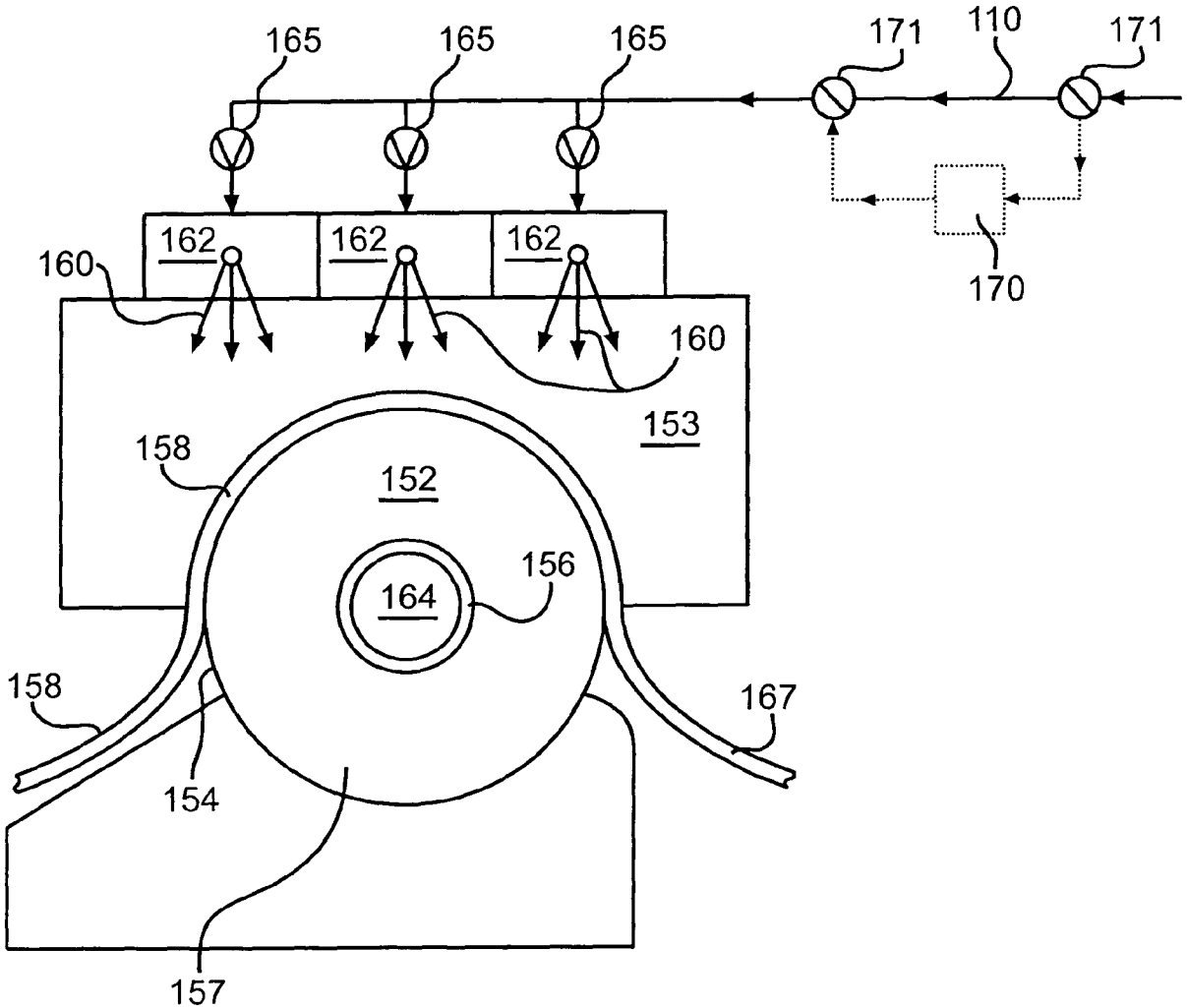
FIG. 4 is a front view of another type of oven useful in the system and process of the invention.

FIG. 4 shows another type of oven used in the invention to dry wet mat and optionally, to heat the mat further to cure a binder contained therein. This drying oven, normally called a Honeycomb™ type oven, is comprised of a large drum 152 having a permeable, outer cylindrical skin 154 and an inner, permeable axle 156 for rotating the drum 152. The ends of the drum 152 are normally capped with an impermeable wall 157. The wet, permeable mat 158, is fed onto the rotating, permeable outer surface 154 of the drum 152. At least the drying area of the oven 150 has a chamber 153 surrounding at least that portion of the outer cylindrical permeable surface 154 carrying the nonwoven mat. Hot gases 160, produced by one or more combustion chambers, each normally containing one or more burners using a fuel and air, is drawn into the chamber 153 and through the mat 158, through the permeable outer surface 154, through the inner permeable surface of the axle 156 and out through an exhaust duct 164, formed by the axle 156, to one or both ends of the axle 152, by a suction fan (not shown) in a conventional manner. The hot gases 160, passing through the wet mat 158, heats the mat and water or solvent, removing the water or solvent through the exhaust duct 164, and optionally, once the mat is dry, heats the mat further to cure a binder contained in the mat. A hot, dry mat 164 is removed from the drum surface 156 and processed as described for the hot, dry mat 134 described above.

In the invention using the drum 152, the hot gases 110 from the gas turbine electrical generating system 100, or a similar system, are pulled or forced into the chamber 153, normally through the one or more of the combustion chambers 162 to supply all or a part of the hot gases 160 for drying the mat and/or for heating the mat to cure the binder in the mat. Again, where it is desirable to subject the mat to only hot air, the hot gases can optionally be run through a conventional heat exchanger 170 also fed with ambient air 171 and the hot air 172 fed to the chamber 153 directly or indirectly as above. As in the system of FIG. 3, the temperature of the hot waste gases 110 can also be reduced before being introduced into the drum dryer by injecting cooler air or gases into the duct carrying the waste hot gases 110 prior to entry into the chamber 153.

The invention is useful in any fibrous mat production system and process for making fibrous mats, whether formed dry or wet, but containing water or a solvent that must be removed, and having a permeability of at least about 100 cubic feet/square feet per minute after the mat has been dried. The invention is useful in any type of oven that is used to remove water or solvent from such fibrous mats.

Different embodiments employing the concept and teachings of the invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. In a system for making a permeable, fibrous nonwoven mat comprising glass fibers bound together with a resinous binder having a dry permeability of at least about 100 cubic feet/square foot/minute comprising a permeable carrier for the wet, fibrous nonwoven mat, an oven for removing water or a solvent from the wet fibrous nonwoven mat by heating the fibrous nonwoven mat and water or solvent with hot gases at a pressure of less than about 18 inches of water column to volatilize the water or solvent to produce a dry fibrous nonwoven mat and one or more burners for producing hot gases, the improvement comprising an electrical generating system comprising a heat engine and one or more ducts for carrying waste hot gases having a temperature of 390 degrees C. or higher and a pressure of less than 18 inches of water column from a source that includes the electrical generating system comprising the heat engine, driven by hot, high pressure, gases, and/or hot waste gases from a glass melting furnace to the oven to replace all or a part of the hot gases normally supplied by one or more combustion burners, to remove the water or solvent from the wet, fibrous nonwoven mat to form a dried fibrous nonwoven mat and to heat the dried fibrous nonwoven mat to a temperature in the range of 105 to 260 degrees C. to cure the resinous binder.

2. The system of claim 1 further comprising one or more combustion chambers for the one or more burners.

3. The system of claim 1 further comprising one or more suction fans for pulling the waste hot gases from the one or more ducts through the wet mat.

4. The system of claim 2 further comprising one or more suction fans for pulling the waste hot gases from the one or more ducts through the wet mat.

5. The system of claim 2 wherein the hot waste gases come from both the electrical generating system comprising a heat engine and the glass melting furnace.

6. The system of claim 1 wherein the hot waste gases come from both the electrical generating system comprising a heat engine and the glass melting furnace.

7. The system of claim 1 wherein the heat engine is a gas turbine.

8. In a method of making a permeable fibrous nonwoven mat comprising glass fibers bound together with a resinous binder and having a dry permeability of at least about 100 cubic feet/square foot/minute including the steps of passing a wet fibrous nonwoven mat comprising glass fibers into an oven and removing water or a solvent in the wet fibrous nonwoven mat from the fibrous nonwoven mat by heating the fibrous nonwoven mat and water or solvent with hot gases at a pressure of less than about 18 inches of water column to volatilize the water or solvent to produce a dry nonwoven mat comprising glass fibers bound together with a cured resinous binder, the improvement comprising using an electrical generating system comprising a heat engine to generate electricity and using waste hot exhaust gases from the heat engine driving the electrical generating system and/or hot gases heated by waste hot gases from a glass melting furnace, the waste hot gases having a temperature of 390 degrees C. or higher and a pressure of less than about 18 inches of water column, for all or a part of the hot gases used in the oven to remove the water or solvent from the fibrous mat to form a dried fibrous nonwoven mat and to heat the dried fibrous nonwoven mat to a temperature in the range of 105 to 260 degrees C.

9. The method of claim 8 wherein the wet fibrous mat contains water or solvent in an amount of about 30-90 wt. percent.

10. The method of claim 8 wherein the temperature of the waste hot gases is at least about 450 degrees C.

11. The method of claim 9 wherein the temperature of the waste hot gases is at least about 450 degrees C.

12. The method of claim 8 wherein the fibrous mat is heated to a temperature sufficiently high to cure the resinous binder in the dried nonwoven mat and in the range of about 105-260 degrees C. using the waste hot gases.

13. The method of claim 9 wherein the fibrous mat is heated to a temperature sufficiently high to cure the resinous binder in the dried nonwoven mat and in the range of about 105-260 degrees C. using the waste hot gases.

14. The method of claim 10 wherein the fibrous mat is heated to a temperature sufficiently high to cure the resinous binder in the dried nonwoven mat and in the range of about 105-260 degrees C. using the waste hot gases.

15. The method of claim 8 wherein the temperature of the waste hot gases is at least about 540 degrees C.

16. The method of claim 9 wherein the temperature of the waste hot gases is at least about 540 degrees C.

17. The method of claim 15 wherein the fibrous mat is heated to a temperature sufficiently high to cure the resinous binder in the dried nonwoven mat and in the range of about 105-260 degrees C. using the waste hot gases.

18. The method of claim 16 wherein the fibrous mat is heated to a temperature sufficiently high to cure the resinous binder in the dried nonwoven mat and in the range of about 105-260 degrees C. using the waste hot gases.

19. In a method of making a permeable nonwoven mat containing glass fibers bound together with a binder and having a dry permeability of at least about 100 cubic feet/square foot/minute including the steps of passing a wet nonwoven mat containing glass fibers and a resinous binder into an oven and removing water or a solvent in the wet fibrous mat from the fibrous mat by heating the fibrous mat and water or solvent with hot gases to volatilize the water or solvent to produce a dry mat, the improvement comprising using waste hot exhaust gases having a temperature of at least 105 degrees C. and sufficiently high to heat the dry mat and to cure the resinous binder, the waste hot gases taken from a heat engine in an electrical generating system for all or a part of the hot gases used in the oven to remove the water or solvent from the wet nonwoven mat containing glass fibers and to cure the resinous binder.

20. The method of claim 19 wherein the dry nonwoven mat containing glass fibers and a resinous binder is heated to a temperature in the range of about 105-260 degrees C. to cure the resinous binder for bonding the fibers together with a cured resin.

* * * * *